US011611165B2

(12) United States Patent
Kobayashi et al.

(10) Patent No.: US 11,611,165 B2
(45) Date of Patent: Mar. 21, 2023

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroki Kobayashi, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 193 days.

(21) Appl. No.: 17/280,762

(22) PCT Filed: Oct. 10, 2019

(86) PCT No.: PCT/JP2019/039929
§ 371 (c)(1),
(2) Date: Mar. 26, 2021

(87) PCT Pub. No.: WO2020/090398
PCT Pub. Date: May 7, 2020

(65) Prior Publication Data

US 2022/0045449 A1 Feb. 10, 2022

(30) Foreign Application Priority Data

Oct. 30, 2018 (JP) ..... JP2018-203621

(51) Int. Cl.
*H01R 12/79* (2011.01)
*H01B 7/04* (2006.01)
(Continued)

(52) U.S. Cl.
CPC ..... *H01R 12/79* (2013.01); *H01B 7/04* (2013.01); *H01B 7/08* (2013.01); *H01R 13/502* (2013.01);
(Continued)

(58) Field of Classification Search
CPC ..... H91R 12/79; H01R 13/629; H01B 7/04
See application file for complete search history.

(56) References Cited

U.S. PATENT DOCUMENTS 3,149,896 A * 9/1964 Hall ..... H01R 12/79 439/495
3,214,713 A * 10/1965 Strobel ..... H01R 12/59 439/418
(Continued)

FOREIGN PATENT DOCUMENTS

DE 10107233 A1 5/2002
JP 2000-077124 A 3/2000
(Continued)

OTHER PUBLICATIONS

International Search Report dated Dec. 17, 2019 for WO 2020/090398 A1 (2 pages).

*Primary Examiner* — Neil Abrams
(74) *Attorney, Agent, or Firm* — Venjuris, P.C.

(57) ABSTRACT

It is aimed to reduce a load to fixing portions of a flat cable and terminal fittings. A connector (A) includes a flat cable formed such that a plurality of conductors are arranged in parallel on a flexible insulating sheet, a plurality of terminal fittings held in a housing and individually fixed to front end parts of the plurality of conductors, and a reinforcing plate laminated on and integrated with a region of the insulating sheet including fixing portions of the conductors and the terminal fittings. The reinforcing plate is provided with hooking portions. The housing is formed with stoppers for restricting a rearward displacement of the flat cable with
(Continued)

respect to the housing by being brought into contact with the hooking portions. A low-rigidity portion is formed in a region of the reinforcing plate rearward of the fixing portions and forward of the hooking portions.

5 Claims, 9 Drawing Sheets

(51) Int. Cl.
*H01B 7/08* (2006.01)
*H01R 13/502* (2006.01)
*H01R 13/629* (2006.01)
*H01R 13/639* (2006.01)

(52) U.S. Cl.
CPC ..... *H01R 13/629* (2013.01); *H01R 13/639* (2013.01)

(56) References Cited

U.S. PATENT DOCUMENTS 3,235,833 A * 2/1966 Elm ..... H01R 4/2445 439/456
3,245,024 A * 4/1966 Evans ..... H01R 13/113 439/468
3,641,482 A * 2/1972 Bretting ..... H01R 12/777 439/460
3,691,509 A * 9/1972 Krol ..... H01R 12/775 439/465
3,842,394 A * 10/1974 Bolduc ..... A61B 18/16 439/727
4,194,805 A * 3/1980 Ayer ..... H01R 13/504 439/480
4,225,205 A * 9/1980 Sinclair ..... H01R 12/777 439/499
4,382,652 A * 5/1983 Sinclair ..... H01R 12/778 439/936
5,356,308 A * 10/1994 Toba ..... H01R 13/5219 439/495
5,591,041 A * 1/1997 Cecil, Jr. ..... H01R 13/639 439/352
5,924,891 A * 7/1999 Benjamin ..... H01R 12/85 439/495
5,944,554 A * 8/1999 Armand ..... H01R 12/89 439/449
6,062,900 A * 5/2000 Juntwait ..... H01R 13/582 439/495
6,361,358 B1 * 3/2002 Kajinuma ..... H01R 12/79 439/422
6,388,883 B1 * 5/2002 Serizawa ..... B60R 16/0215 361/752
6,416,350 B1 * 7/2002 Harting ..... H05K 3/326 439/459
6,435,885 B2 * 8/2002 Araki ..... H01R 43/0207 439/874
6,443,758 B2 * 9/2002 Nagai ..... H01R 13/4361 439/465
6,464,532 B1 * 10/2002 L'Abbate ..... H01R 12/772 439/499
6,659,794 B2 * 12/2003 Yamatani ..... H01R 13/501 439/495
6,746,269 B1 * 6/2004 Casses ..... H01R 4/2495 439/422
6,755,679 B2 * 6/2004 Godefroy ..... H01R 12/592 439/492
7,273,388 B2 * 9/2007 Kumakura ..... H01R 12/68 439/422
7,955,106 B1 * 6/2011 Crow ..... H02G 3/288 29/857
10,193,255 B2 * 1/2019 Ito ..... H01R 12/78
10,490,922 B2 * 11/2019 Takase ..... H01R 12/78
11,069,994 B2 * 7/2021 Peterson ..... H01R 43/28
2006/0286848 A1 * 12/2006 Kumakura ..... H01R 12/67 439/422
2010/0190373 A1 * 7/2010 Yeh ..... H01R 12/774 439/499
2022/0029327 A1 * 1/2022 Nagasaka ..... H01R 12/771
2022/0045449 A1 * 2/2022 Kobayashi ..... H01R 13/502
2022/0123504 A1 * 4/2022 Sato ..... H01R 13/6272
2022/0190501 A1 * 6/2022 Obata ..... H01R 12/772

FOREIGN PATENT DOCUMENTS

JP 2003-203740 A 7/2003
JP 2006-172751 A 6/2006
JP 2017-204379 A 11/2017

* cited by examiner

CONNECTOR

CROSS REFERENCE TO RELATED APPLICATIONS

This application is a national phase of PCT application No. PCT/JP2019/039929, filed on 10 Oct. 2019, which claims priority from Japanese patent application No. 2018-203621, filed on 30 Oct. 2018, all of which are incorporated herein by reference.

TECHNICAL FIELD

The present disclosure relates to a connector.

BACKGROUND

Patent Document 1 discloses a connector with a housing and a flexible flat cable. A plurality of connection terminals are inserted into a housing from behind, and the plurality of inserted connection terminals are arranged in parallel while being retained by the locking action of locking lances. The flexible flat cable is formed such that a plurality of flat plate-like conductors are arranged in parallel on an insulating base film. The plurality of connection terminals are individually fixed to front end parts of the respective flat plate-like conductors.

PRIOR ART DOCUMENT

Patent Document

Patent Document 1: JP 2003-203740 A

SUMMARY OF THE INVENTION

Problems to be Solved

In this connector, if the flexible flat cable is pulled rearward, a stress is caused in fixing parts of the retained connection terminals and the flat plate-like conductors receiving a pulling force. Thus, a connected state of the connection terminals and the flat plate-like conductors may become unstable or the flat plate-like conductors may be detached from the connection terminals.

The present invention was completed on the basis of the above situation and aims to reduce a load to fixing parts of a flat cable and terminal fittings.

Means to Solve the Problem

The present disclosure is directed to a connector with a flat cable formed such that a plurality of conductors are arranged in parallel on a flexible insulating sheet, a plurality of terminal fittings held in a housing and individually fixed to front end parts of the plurality of conductors, and a reinforcing plate laminated on and integrated with a region of the insulating sheet including fixing portions of the conductors and the terminal fittings, wherein the reinforcing plate is provided with a hooking portion, the housing is formed with a stopper for restricting a rearward displacement of the flat cable with respect to the housing by being brought into contact with the hooking portion, and a low-rigidity portion is formed in a region of the reinforcing plate rearward of the fixing portions and forward of the hooking portion.

Effect of the Invention

According to the present disclosure, it is possible to reduce a load to fixing portions of a flat cable and terminal fittings.

DETAILED DESCRIPTION TO EXECUTE THE INVENTION

Description of Embodiments of Present Disclosure

Figure 1:
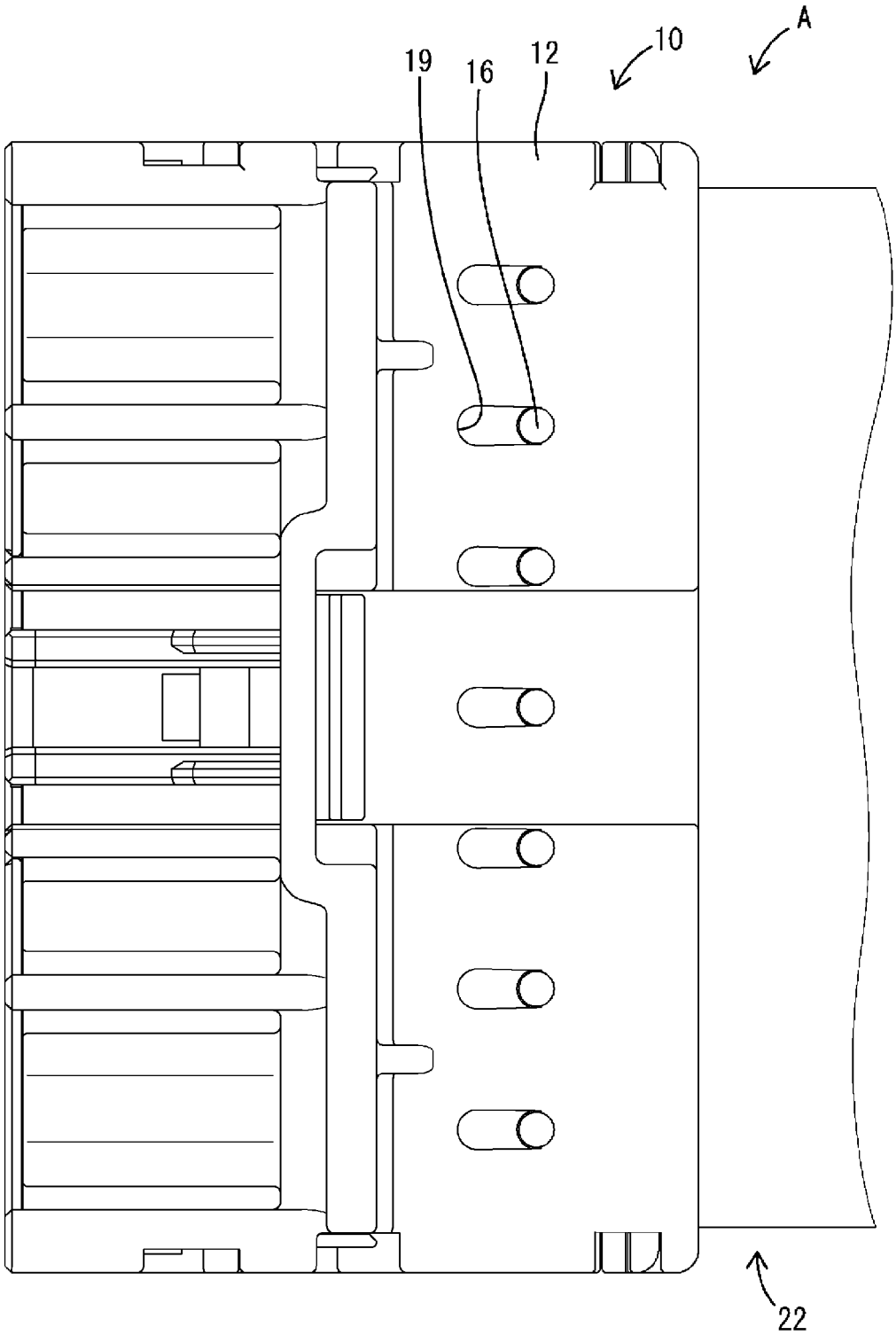
FIG. 1 is a plan view of a connector of one embodiment.
Figure 2:
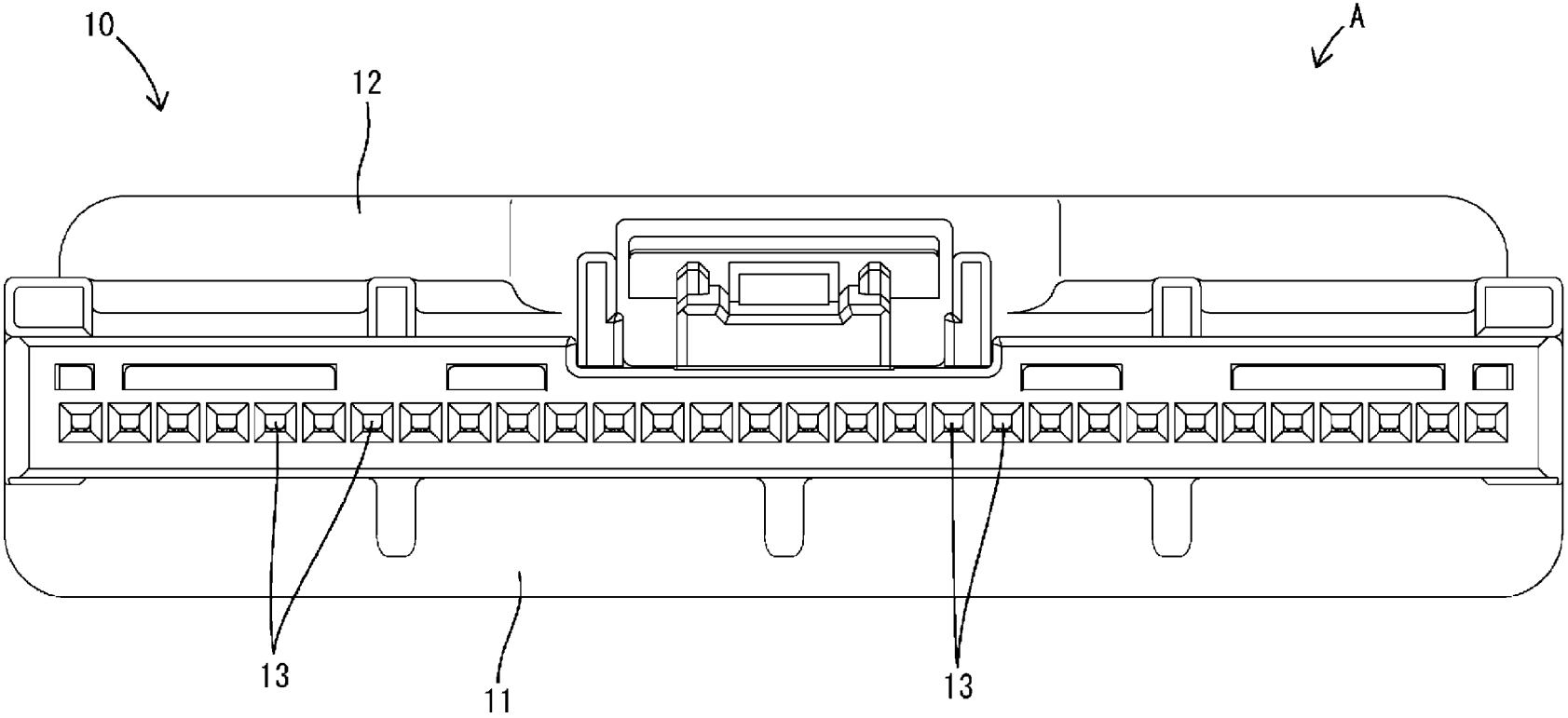
FIG. 2 is a front view of the connector.

First, embodiments of the present disclosure are listed and described.

(1) The connector of the present disclosure includes a flat cable formed such that a plurality of conductors are arranged in parallel in a flexible insulating sheet, a plurality of terminal fittings held in a housing and individually fixed to front end parts of the plurality of conductors, and a reinforcing plate laminated on and integrated with a region of the insulating sheet including fixing portions of the conductors and the terminal fittings, wherein the reinforcing plate is provided with a hooking portion, the housing is formed with a stopper for restricting a rearward displacement of the flat cable with respect to the housing by being brought into contact with the hooking portion, and a low-rigidity portion is formed in a region of the reinforcing plate rearward of the fixing portions and forward of the hooking portion.

According to the configuration of the present disclosure, even if a rearward pulling force acts on the flat cable, the hooking portion comes into contact with the stopper to restrict a rearward displacement of the flat cable. At this time, even if there is a clearance in a front-rear direction between the stopper and the hooking portion, the pulling force does not strongly act on the fixing portions of the conductors and the terminal fittings since the insulating sheet and the low-rigidity portion are extended in the front-rear direction.

(2) Preferably, the low-rigidity portion is constituted by a thin portion thinner than corresponding regions to the fixing portions and a formation region of the hooking portion, out of the reinforcing plate. According to this configuration, the reinforcing plate can be a single member made of the same material.

(3) Preferably, the thin portion is formed by recessing an outer surface of the reinforcing plate opposite to the insulating sheet. According to this configuration, a processing for forming the thin portion is easy.

(4) Preferably, a recessed surface of the thin portion is shaped to include a curved surface. According to this configuration, since a stress caused in the recessed surface of the thin portion is dispersed when the thin portion is extended in the front-rear direction, the breakage of the thin portion can be prevented.

(5) Preferably, a front end side region of the flat cable is formed such that a plurality of branch portions cantilevered forward are arranged in parallel like comb teeth, the plurality of terminal fittings are individually fixed to front end parts of the plurality of branch portions, and the low-rigidity portion is disposed only in a region of the reinforcing plate rearward of the plurality of branch portions and continuous over an entire width of the flat cable. According to this configuration, since the low-rigidity portion is not formed in the respective branch portions, the resilient deformation of the branch portions is suppressed. In this way, the positions and orientations of the terminal fittings can be stabilized in a state where the terminal fittings are not held in the housing.

DETAILS OF EMBODIMENTS OF PRESENT DISCLOSURE

Embodiment

Hereinafter, one specific embodiment of the present disclosure is described with reference to FIGS. 1 to 9. Note that the present invention is not limited to these illustrations and is intended to be represented by claims and include all changes in the scope of claims and in the meaning and scope of equivalents. In the following description, a left side in FIGS. 1, 3 to 5 and 7 to 9 is defined as a front side concerning a front-rear direction. Upper and lower sides shown in FIGS. 2 to 6 and 8 are directly defined as upper and lower sides concerning a vertical direction.

Figure 3:
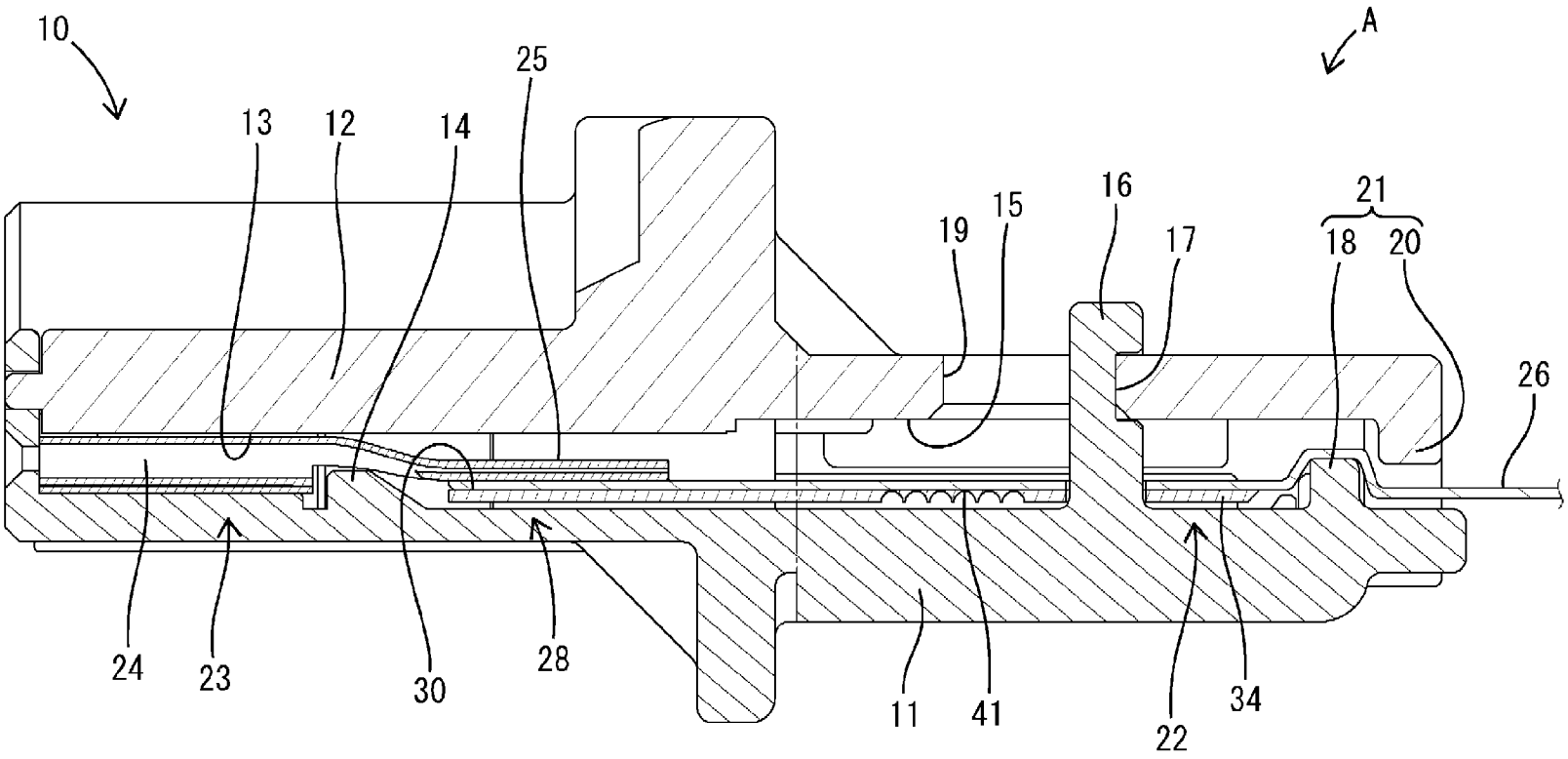
FIG. 3 is a side view in section of the connector.

A connector A of this embodiment is configured by assembling a housing 10 and a flexible conductive path 22. As shown in FIG. 3, the housing 10 is formed by vertically overlapping and uniting a lower housing 11 made of synthetic resin and having a flat shape as a whole and an upper housing 12 made of synthetic resin and having a flat shape as a whole.

Figure 4:
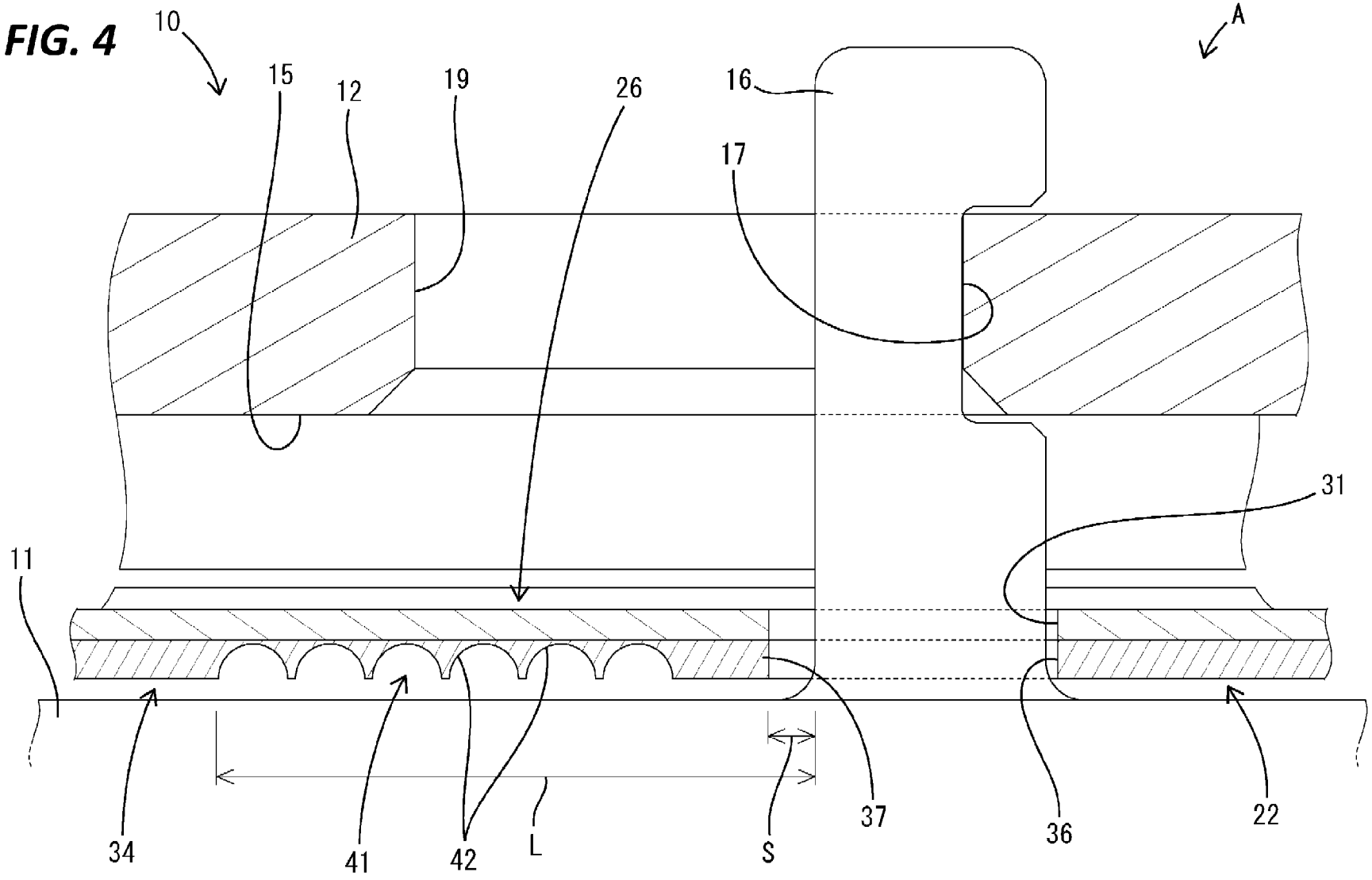
FIG. 4 is a partial enlarged side view in section.
Figure 5:
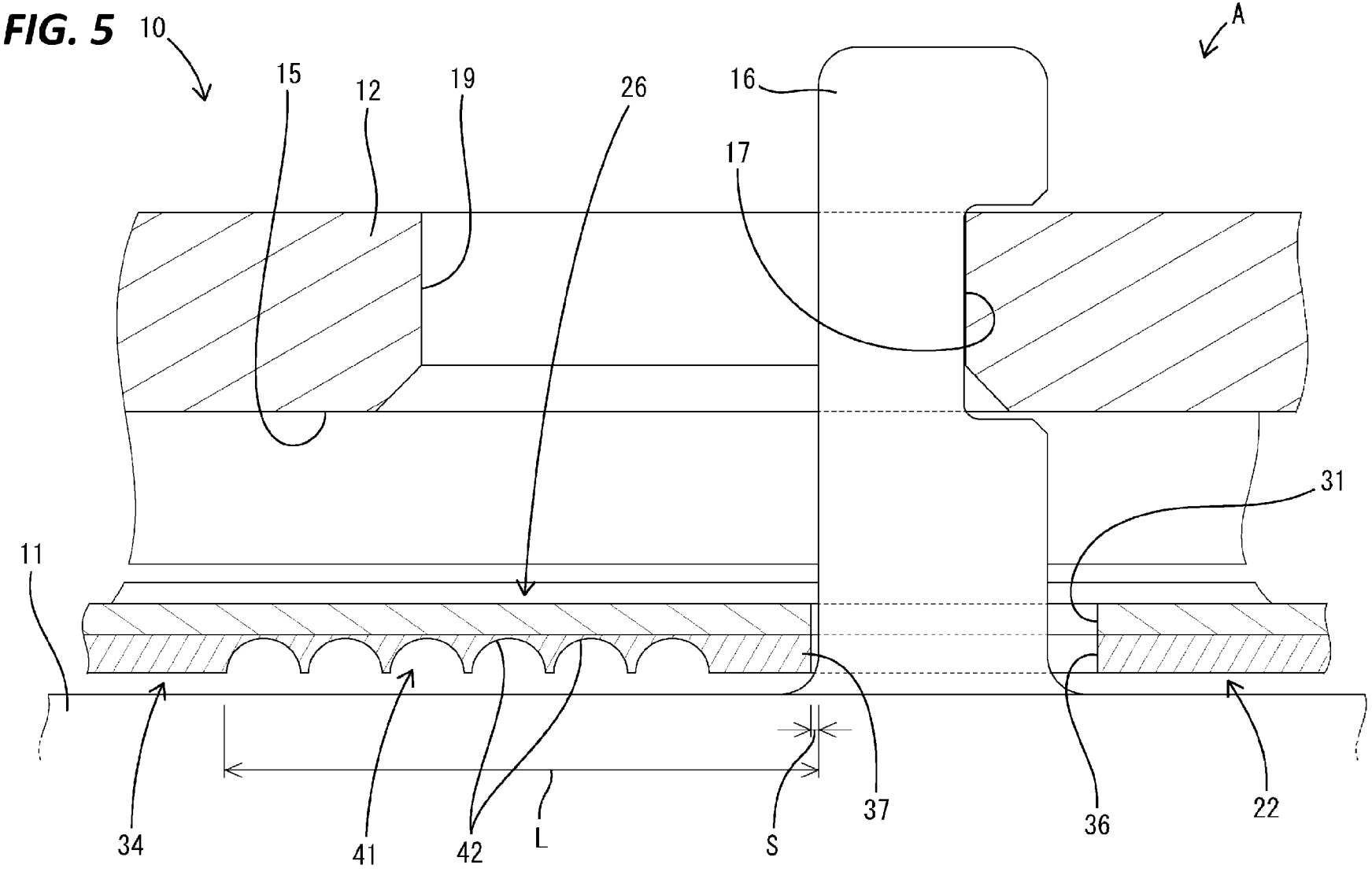
FIG. 5 is a partial enlarged side view in section showing a state where a low-rigidity portion is elongated.
Figure 6:
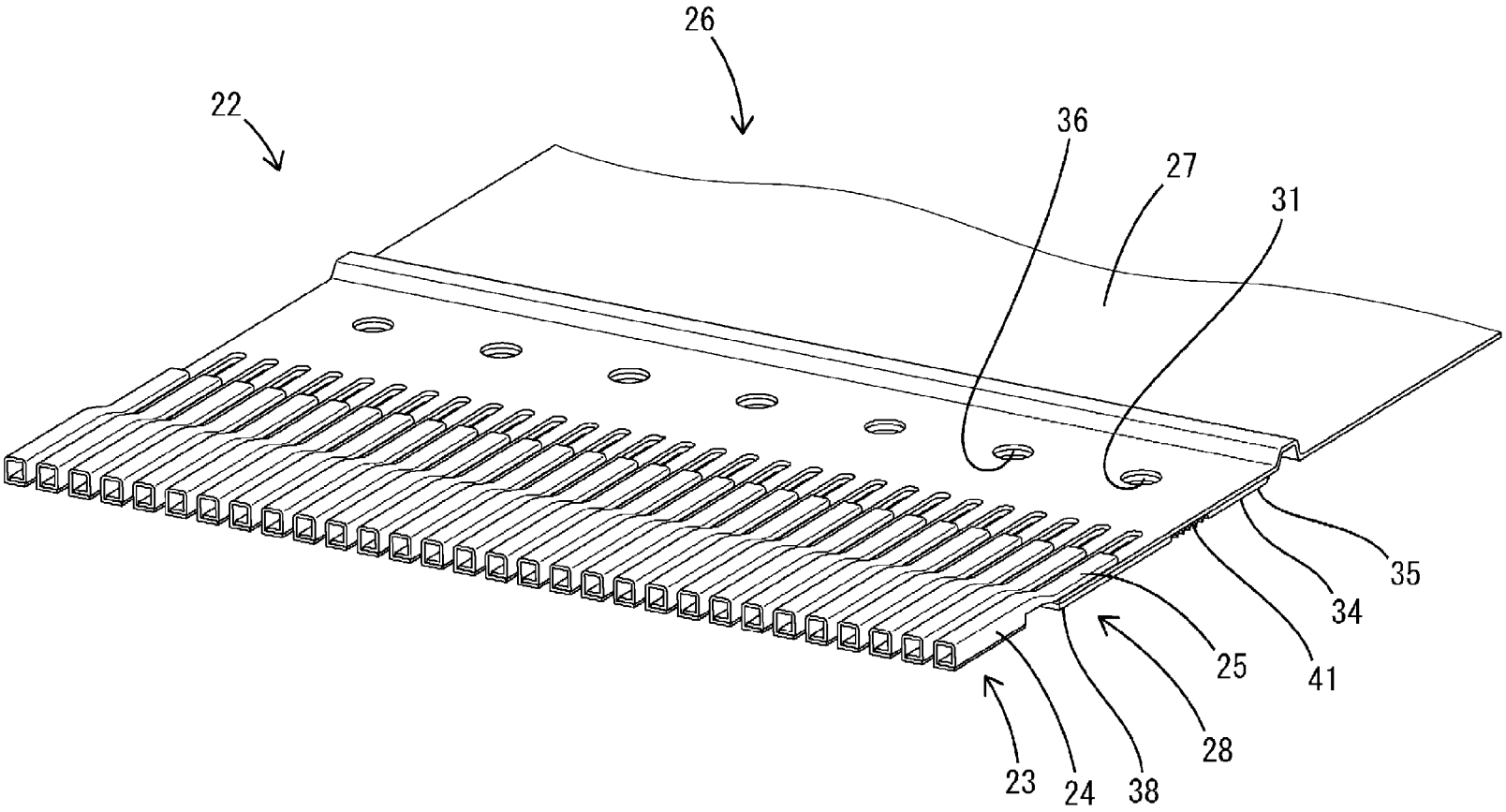
FIG. 6 is a perspective view of a flexible conductive path.

A plurality of terminal accommodation chambers 13 elongated in the front-rear direction are formed laterally in parallel in a front end side region in the housing 10. A step-like retaining portion 14 projecting from the upper surface of the lower housing 11 is formed in each terminal accommodation chamber 13. The front end of each terminal accommodation chamber 13 is exposed to the outside of the housing 10 in the front end surface of the housing 10. As shown in FIGS. 3 to 5, one cable accommodation chamber 13 is formed in a rear end side region in the housing 10. The front end of the cable accommodation chamber 15 communicates with the rear ends of all the terminal accommodation chambers 13. The rear end of the cable accommodation chamber 15 is in the form of a laterally long slit open in the rear end surface of the housing 10.

As shown in FIGS. 3 to 5, a region constituting the cable accommodation chamber 15, out of the upper surface of the lower housing 11, is integrally formed with a plurality of cylindrical stoppers 16 cantilevered upward and spaced apart in a lateral direction. A rear surface part of the stopper 16 is cut to form a locking recess 17. An upward rib 18 extending in the lateral direction over the entire width of the cable accommodation chamber 15 is formed in a rear end part of the upper surface of the lower housing 11.

As shown in FIGS. 1 and 3 to 5, a wall part of the upper housing 12 constituting the cable accommodation chamber 15 is formed with a plurality of vertically penetrating long holes 19 spaced apart in the lateral direction. The stoppers 16 are passed through the long holes 19, and rear edge parts of opening edge parts of the long holes 19 are fit into the locking recesses 17 of the stoppers 16. By this fitting, the separation of the lower housing 11 and the upper housing 12 in the vertical direction is restricted. A downward rib 20 extending in the lateral direction over the entire width of the cable accommodation chamber 15 is formed in a rear end part of the lower surface of the upper housing 12. As shown in FIG. 3, the downward rib 20 and the upward rib 18 of the lower housing 11 constitute a strain relief portion 21.

As shown in FIGS. 3 and 6 to 9, the flexible conductive path 22 includes a plurality of terminal fittings 23 to be individually accommodated into the plurality of terminal accommodation chambers 13 and a flexible flat cable 26. The terminal fitting 23 has a shape elongated in the front-rear direction as a whole. A front end part of the terminal fitting 23 serves as a terminal body portion 24 in the form of a rectangular tube to be connected to a board-side terminal (not shown) of a board connector (not shown). A rear end part of the terminal fitting 23 serves as a terminal-side fixing portion 25 (fixing portion as claimed) in the form of a rectangular tube extending rearward from the rear end of the terminal body portion 24.

Figure 7:
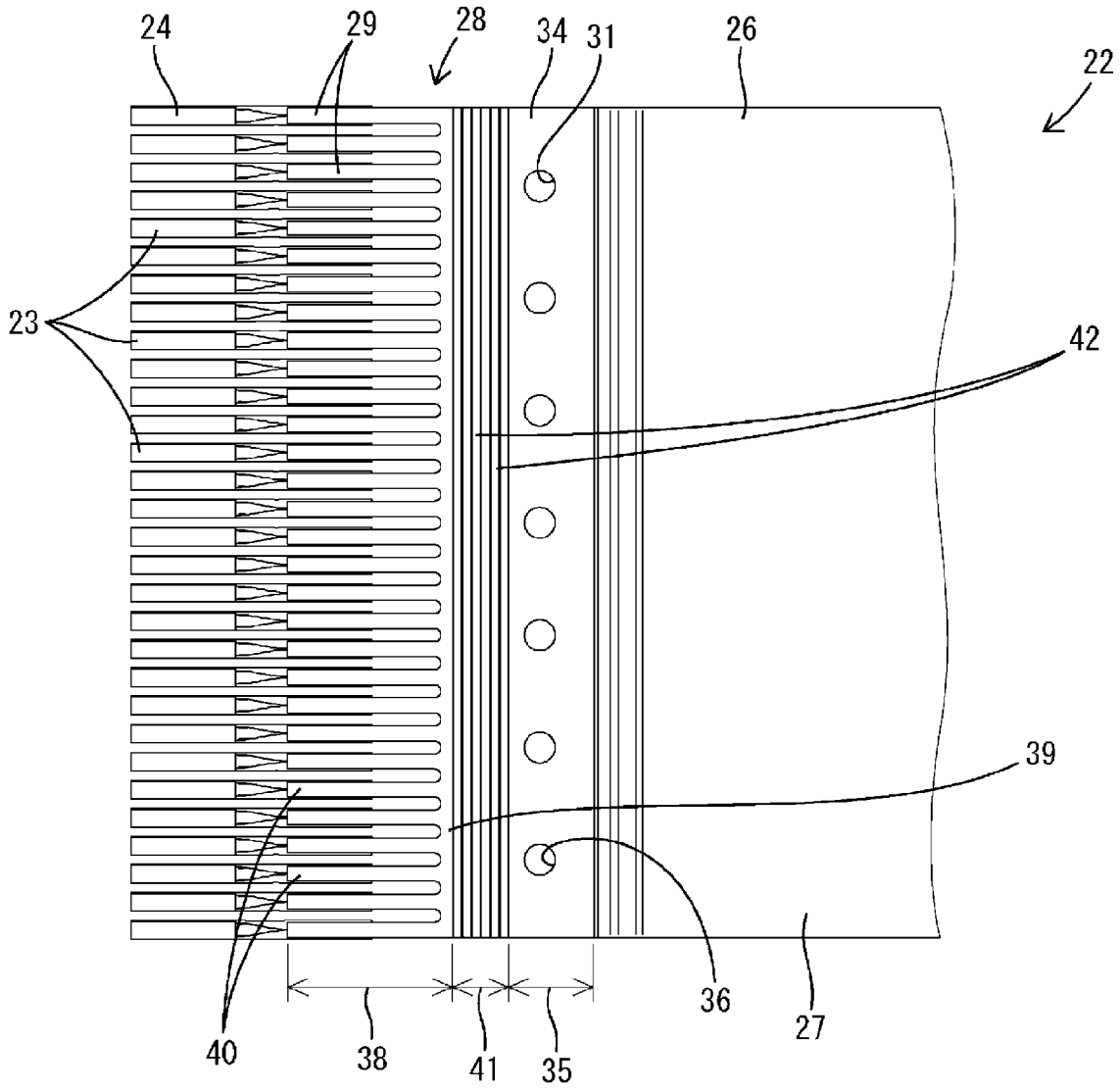
FIG. 7 is a bottom view of the flexible conductive path.
Figure 8:
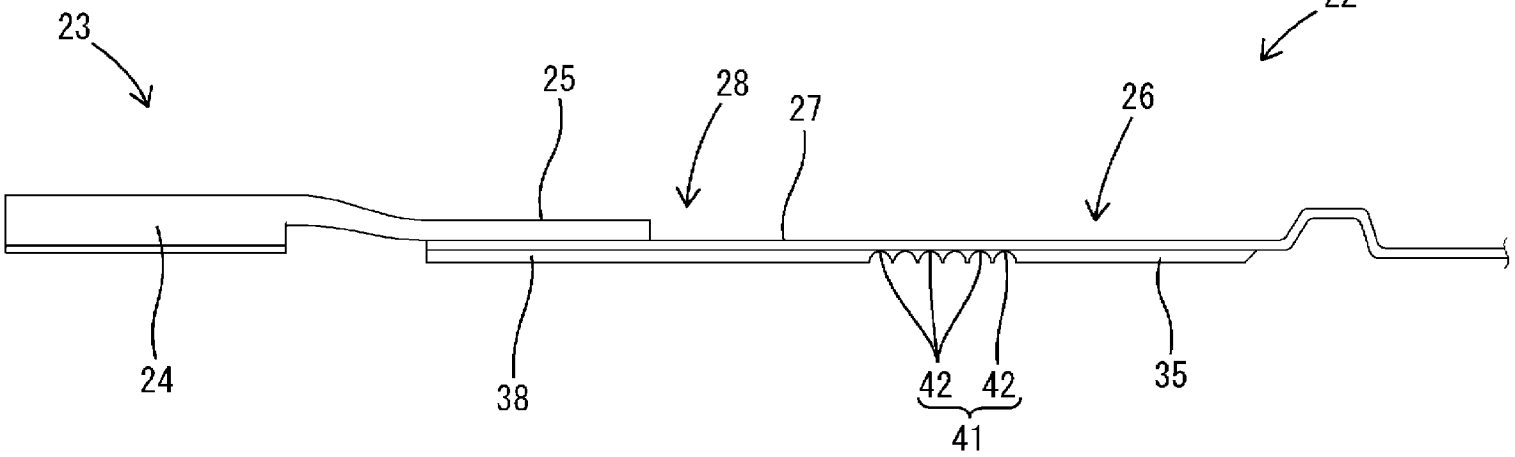
FIG. 8 is a side view of the flexible conductive path.

The flat cable 26 includes an insulating sheet 27 made of synthetic resin (insulating material), a plurality of conductors 32 routed while being embedded in the insulating sheet 27, and a reinforcing plate 34 for enhancing the flexural rigidity of a front end part of the insulating sheet 27. As shown in FIG. 7, a terminal fixing portion 28 is formed in a front end part of the flat cable 26. The terminal fixing portion 28 is formed such that a plurality of branch portions 29 cantilevered forward are arranged in parallel like comb teeth while being spaced apart in the lateral direction.

The insulating sheet 27 is made of a material capable of being flexibly curved and deformed and has the same shape as the entire region of the flat cable 26. A front end part of the insulating sheet 27 constituting the terminal fixing portion 28 serves a plurality of branched support portions 30 cantilevered forward. A plurality of circular through holes 31 are formed while being spaced apart in the lateral direction in a part of the insulating sheet 27 rearward of the branched support portions 30. The plurality of through holes 31 are arranged at positions corresponding to the plurality of stoppers 16. An inner diameter of the through hole 31 is set to be slightly larger than an outer diameter of the stopper 16.

Figure 9:
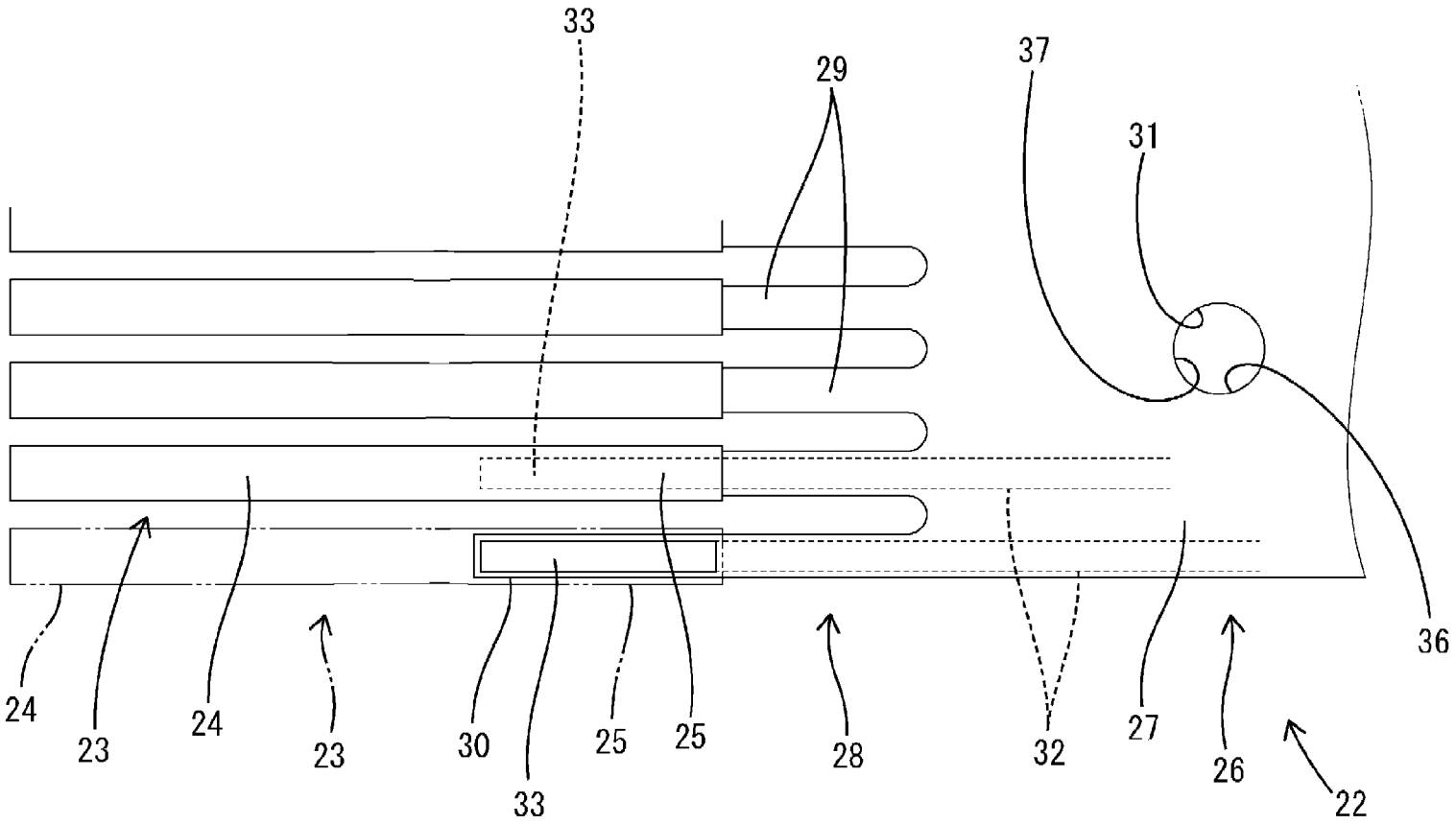
FIG. 9 is a partial enlarged plan view of the flexible conductive path.

As shown in FIG. 9, a cable-side fixing portion 33 (fixing portion as claimed) in a front end part of the conductor 32 is exposed in the upper surface of the branched support portion 30. The terminal-side fixing portion 25 (fixing portion as claimed) of the terminal fitting 23 is placed on the upper surface of the branched support portion 30, and the terminal-side fixing portion 25 and the cable-side fixing portion 33 are conductively fixed by soldering or the like. The terminal body portion 24 of the terminal fitting 23 connected to the conductor 32 is cantilevered forward from the branch portion 29 (branched support portion 30).

Since each branch portion 29 has an elongated shape, if the terminal fitting 23 is mounted on the branch portion 29, the branch portion 29 may be improperly resiliently deformed by the weight of the terminal fitting 23. As a countermeasure against that, the reinforcing plate 34 is laminated on and integrated with the lower surface of the insulating sheet 27 (surface of the insulating sheet 27 on a side opposite to a side to which the terminal fittings 23 are fixed) by means such as welding. The reinforcing plate 34 is made of a synthetic resin material having a larger Young's modulus than the insulating sheet 27. A thickness of the reinforcing plate 34 is substantially equal to that of the insulating sheet 27.

The reinforcing plate 34 is a single member and disposed only on a front end part of the flat cable 26 (insulating sheet 27). As shown in FIG. 7, the reinforcing plate 34 is composed of one base portion 35 constituting a rear end part of the reinforcing plate 34, one comb teeth-like reinforcing portion 38 constituting a front end part of the reinforcing plate 34, and one low-rigidity portion 41 linking the front end of the base portion 35 and the rear end of the comb teeth-like reinforcing portion 38. The reinforcing plate 34 has a function as a mother body forming hooking portions 37 configured to come into contact with the stoppers 16 and a function of stabilizing the positions and orientations of the terminal fittings 23 by suppressing the deformation of the insulating sheet 27 branched in a comb-teeth manner (branch portions 29).

The base portion 35 is disposed in a region rearward of the branch portions 29 and integrated with the insulating sheet 27 over the entire width of the flat cable 26. The base portion 35 is rectangular in a plan view. The base portion 35 is formed with a plurality of locking holes 36 individually corresponding to the plurality of through holes 31 in a plan view. The locking hole 36 penetrates through the base portion 35 and has a circular opening. As shown in FIGS. 4 and 5, a front end edge part in the opening edge of the locking hole 36 serves as the hooking portion 37. The base portion 35 constitutes a formation region for the hooking portions 37 (locking holes 36) in the reinforcing plate 34.

An inner diameter of the locking hole 36 is set to be larger than the outer diameter of the stopper 16 and, as shown in FIG. 4, a predetermined clearance S is secured between the hooking portion 37 (opening edge of the locking hole 36) and the front end of the outer peripheral surface of the stopper 16. A dimensional difference between the inner diameter of the locking hole 36 and the outer diameter of the stopper 16 is set in view of dimensional tolerances of each component and assembling tolerances between components. By this dimension setting, the stopper 16 is passed through the locking hole 36 without improperly deforming the base portion 35.

The comb teeth-like reinforcing portion 38 is composed of a base part 39 elongated in the lateral direction over the entire width of the flat cable 26 and a plurality of branched reinforcing parts 40 arranged in parallel while being spaced apart in the lateral direction. The branched reinforcing parts 40 constitute regions corresponding to the fixing portions (terminal-side fixing portions 25 and the cable-side fixing portions 33) in the reinforcing plate 34. The plurality of branched reinforcing parts 40 are cantilevered forward from the front end edge of the base part 39. Each branched reinforcing part 40 has the same shape as the branch portion 29 and the branched support portion 30 in a plan view, and is laminated on the lower surface of the branched support portion 30. One branch portion 29 includes the branched support portion 30, the branched reinforcing part 40 and the front end part of the conductor 32 (cable-side fixing portion 33).

The low-rigidity portion 41 has a width over the entire width of the flat cable 26. The low-rigidity portion 41 is rectangular in a plan view (in a bottom view). As shown in FIGS. 4, 5, 7 and 8, the low-rigidity portion 41 is formed with a plurality of thin portions 42 by recessing the lower surface (surface opposite to the insulating sheet 27) of the low-rigidity portion 41 into grooves. Each thin portion 42 is elongated in the lateral direction (direction orthogonal to both a length direction of the flat cable 26 and a thickness direction of the flat cable 26). The plurality of thin portions 42 are arranged in parallel at a constant interval in the front-rear direction.

One thin portion 42 is substantially semicircular in a side view. A recessed surface (lower surface) of the thin portion 42 is constituted only by a curved surface. All the plurality of thin portions 42 constituting the low-rigidity portion 41 have the same cross-sectional shape (side view shape). Since the thin portions 42 have a smaller thickness as compared to a region where the thin portions 42 are not formed, a tensile strength in the front-rear direction is low. The smaller the thickness, the smaller the tensile strength. The tensile strength of the low-rigidity portion 41 is lower than those of the base portion 35 and the comb teeth-like reinforcing portion 38 and substantially equal to or lower than that of the insulating sheet 27.

Since the low-rigidity portion 41 is formed only in a region rearward of the branch portions 29 (branched reinforcing parts 40), the comb teeth-like reinforcing portions 38 (base parts 39 and branched reinforcing parts 40) are high in rigidity. Since the rigidity of the branch portions 29 is enhanced by the branched reinforcing parts 40, even if the terminal fittings 23 are fixed to the front end parts of the branch portions 29, the branch portions 29 are unlikely to be improperly deformed. In this way, the plurality of terminal fittings 23 fixed to the front end part of the flat cable 26 are held in a parallel state.

The flexible conductive path 22 in which the plurality of terminal fittings 23 are integrated with the flat cable 26 is assembled with the housing 10. In assembling, the terminal fittings 23 and the front end part of the flat cable 26 are placed on the upper surface of the lower housing 11. At this time, the front end part of the flat cable 26 is positioned with respect to the lower housing 11 in the front-rear direction and lateral direction by fitting the through holes 31 and the locking holes 36 of the flat cable 26 to the stoppers 16. Simultaneously with this, the rear ends of the terminal body portions 24 of the terminal fittings 23 are hooked to the retaining portions 14 of the lower housing 11 from front to be locked.

Subsequently, the flexible conductive path 22 is covered from above by the upper housing 12, and the lower housing 11 and the upper housing 12 are united. At this time, the locking recesses 17 of the stoppers 16 and the rear edge parts of the long holes 19 of the upper housing 12 are fit to be locked. Further, since a part of the flat cable 26 rearward of the low-rigidity portion 41 is sandwiched by the strain relief portion 21, it is difficult to displace the flat cable 26 in the front-rear direction. The strain relief portion 21 is arranged rearward of the stoppers 16. In the above way, the assembling of the flexible conductive path 22 with the housing 10 is completed.

With the flexible conductive path 22 assembled with the housing 10, rearward displacements of the terminal fittings 23 are restricted by the terminal fittings 23 being locked by the retaining portions 14 and the flat cable 26 is drawn out rearward from the housing 10. Since the inner diameter of the locking hole 36 is set to be slightly larger than the outer diameter of the stopper 16 in view of dimensional tolerances and the like, there is the clearance S in the front-rear direction between the front end part of the stopper 16 and the hooking portion 37 of the locking hole 36 as shown in FIG. 4. Thus, if the flat cable 26 is pulled rearward on an outer rear side of the housing 10, the flat cable 26 is displaceable by an amount corresponding to the clearance S.

At this time, if a rearward pulling force acting on the flat cable 26 acts on welded parts (terminal-side fixing portions 25 and cable-side fixing portions 33) between the terminal fittings 23 and the conductors 32 (flat cable 26), there is a concern that the terminal fittings 23 and the conductors are separated or a contact failure occurs. Accordingly, in this embodiment, the low-rigidity portion 41 is provided between the retaining portions 14 (parts for restricting a rearward displacement of the flexible conductive path 22 with respect to the housing 10) of the flat cable 26 and the stoppers 16 (parts allowing a rearward displacement of the flexible conductive path 22 with respect to the housing 10).

In this way, even if the flat cable 26 is pulled behind the housing 10, the plurality of thin portions 42 constituting the low-rigidity portion 41 are extended in the front-rear direction integrally with the insulating sheet 27 as shown in FIGS. 4 and 5, wherefore the pulling force acting on connecting parts of the terminal fittings 23 and the conductors 32 is drastically relaxed. If the low-rigidity portion 41 is extended, a dimension L in the front-rear direction between the front end of the low-rigidity portion 41 and the hooking portions 37 becomes longer. By the extension of the low-rigidity portion 41, the connected state (fixed state) of the terminal fittings 23 and the conductors 32 is stably maintained.

An assumed maximum stress caused in the low-rigidity portion 41 and the insulating sheet 27 when a rearward pulling force acts on the flat cable 26 behind the housing 10 is set to be smaller than a fixing strength in the fixing portions (terminal-side fixing portions 25 and cable-side fixing portions 33) of the flat cable 26 (conductors 32) and the terminal fittings 23. In this embodiment, the "assumed maximum stress" is defined as a stress assumed to be caused in the low-rigidity portion 41 and the insulating sheet 27 when the low-rigidity portion 41 and the insulating sheet 27 are extended until the hooking portions 37 come into contact with the stoppers 16 if the clearances S between the hooking portions 37 and the stoppers 16 are largest within a tolerance range. The assumed maximum stress can be arbitrarily set by changing the material of the insulating sheet 27, the thickness of the insulating sheet 27, the material of the reinforcing plate 34, the thickness of the low-rigidity portion 41, the cross-sectional shape of the low-rigidity portion 41 and the like.

If the extension in the front-rear direction of the low-rigidity portion 41 continues, the hooking portions 37 of the reinforcing plate 34 contact the front ends of the stoppers 16 as shown in FIG. 5. Since the hooking portions 37 are formed in the base portion 35 having a higher tensile strength than the low-rigidity portion 41 in the reinforcing plate 34, there is no possibility that the base portion 35 (locking holes 36) is deformed. Accordingly, a rearward displacement of the flat cable 26 is restricted and a load to the fixing portions (terminal-side fixing portions 25 and cable-side fixing portions 33) of the terminal fittings 23 and the conductors 32 is not increased.

In the connector A of this embodiment, the flat cable 26 and the plurality of terminal fittings 23 include the reinforcing plate 34. The flat cable 26 is formed such that the plurality of conductors 32 are arranged in parallel on the flexible insulating sheet 27. The plurality of terminal fittings 23 are held in the housing 10 while being individually fixed to the front end parts of the plurality of conductors 32. The reinforcing plate 34 is laminated on and integrated with the region of the insulating sheet 27 including the fixing portions (terminal-side fixing portions 25 and cable-side fixing portions 33) of the conductors 32 and the terminal fittings 23.

The reinforcing plate 34 is provided with the hooking portions 37, and the housing 10 is provided with the stoppers 16 for restricting a rearward displacement of the flat cable 26 with respect to the housing 10 by being brought into contact with the hooking portions 37. The low-rigidity portion 41 is formed in a region of the reinforcing plate 34 rearward of the fixing portions (terminal-side fixing portions 25 and cable-side fixing portions 33) and forward of the hooking portions 37.

If a rearward pulling force acts on a part of the flat cable 26 drawn out rearward from the housing 10, the hooking portions 37 come into contact with the stoppers 16 to restrict a rearward displacement of the flat cable 26. At this time, even if there are the clearances S in the front-rear direction between the stoppers 16 and the hooking portions 37, the pulling force does not strongly act on the fixing portions (terminal-side fixing portions 25 and cable-side fixing portions 33) of the conductors 32 and the terminal fittings 23 since the insulating sheet 27 and the low-rigidity portion 41 are extended in the front-rear direction. In this way, a load to the fixing portions (terminal-side fixing portions 25 and cable-side fixing portions 33) of the flat cable 26 and the terminal fittings 23 is reduced.

Further, the low-rigidity portion 41 is constituted by the thin portions 42 thinner than the corresponding regions (branched reinforcing parts 40) to the fixing portions (terminal-side fixing portions 25 and cable-side fixing portions 33) and the formation region (base portion 35) of the hooking portions 37, out of the reinforcing plate 34. According to this configuration, the reinforcing plate 34 can be a single member made of the same material. The thin portions 42 are formed by recessing the outer surface of the reinforcing plate 34 opposite to the insulating sheet 27. According to this configuration, a processing for forming the thin portions 42 is easy. The recessed surfaces of the thin portions 42 are shaped to include the curved surfaces. According to this configuration, since a stress caused in the recessed surfaces of the thin portions 42 is dispersed when the thin portions 42 are extended in the front-rear direction, the breakage of the thin portions 42 can be prevented.

Further, the front end side region of the flat cable 26 is formed such that the plurality of branch portions 29 cantilevered forward are arranged in parallel like comb teeth. The plurality of terminal fittings 23 are individually fixed to the front end parts of the plurality of branch portions 29. The low-rigidity portion 41 is disposed only in the region of the reinforcing plate 34 rearward of the plurality of branch portions 29 and continuous over the entire width of the flat cable 26. According to this configuration, since the low-rigidity portion 41 is not formed in the respective branch portions 29, the resilient deformation of the branch portions 29 is suppressed. In this way, the positions and orientations of the terminal fittings 23 can be stabilized in a state where the terminal fittings 23 are not held in the housing 10.

Other Embodiments

The present invention is not limited to the above described and illustrated embodiment. For example, the following embodiments are also included in the technical scope of the present invention.

Although the low-rigidity portion is configured by arranging the plurality of thin portions in the front-rear direction in the above embodiment, the low-rigidity portion may be composed of only one thin portion.

Although the recessed surface of the thin portion is constituted only by the curved surface in the above embodiment, the recessed surface of the thin portion may be constituted by a curved surface and a flat surface or may be constituted only by flat surfaces.

Although all the plurality of thin portions constituting the low-rigidity portions have the same cross-sectional shape in the above embodiment, the low-rigidity portion may be formed by arranging a plurality of types of thin portions having different cross-sectional shapes.

Although the low-rigidity portion is constituted only by the thin portions formed by recessing the outer surface of the reinforcing plate opposite to the insulating sheet in the above embodiment, the low-rigidity portion may be constituted only by thin portions formed by recessing the inner surface of the reinforcing plate facing the insulating sheet or may be constituted by thin portions formed by recessing the outer surface of the reinforcing plate and thin portions formed by recessing the inner surface of the reinforcing plate.

Although the reinforcing plate is a single member and the low-rigidity portion is constituted by the thin portions in the above embodiment, the reinforcing plate may be formed by integrating a plurality of types of sheet-like members having different Young's moduli (longitudinal elastic coefficients) by two-color molding or the like and a part having a smaller Young's modulus may be caused to function as a low-rigidity portion.

Although the low-rigidity portion is formed only in the region rearward of the branch portions in the above embodiment, at least a part of the low-rigidity portion may be formed in the branch portions.

Although the terminal fitting is retained by being locked by the step-like retaining portion in the above embodiment, the terminal fitting may be retained by the locking action of a resiliently deformable locking lance.

Although the terminal fitting and the conductor are connected by soldering (welding) in the above embodiment, the terminal fitting and the conductor may be connected by crimping.

Although the housing is formed by uniting the lower housing and the upper housing in the above embodiment, the housing may be a single component.

Although the stoppers are integrally formed to the housing in the above embodiment, the stoppers may be components separate from the housing and assembled with the housing.

Although the hooking portions are integrally formed to the reinforcing plate in the above embodiment, the hooking portions may be components separate from the reinforcing plate and mounted on the reinforcing plate.

Although the front end edge part in the opening edge of the locking hole in the reinforcing plate serves as the hooking portion in the above embodiment, the hooking portion may project from the surface of the reinforcing plate.

Although the stoppers also have a function of holding the lower housing and the upper housing in the united state in the above embodiment, the stoppers may not have the function of holding the lower housing and the upper housing in the united state.

LIST OF REFERENCE NUMERALS

A . . . connector
L . . . dimension in front-rear direction between front end of low-rigidity portion 41 and hooking portions 37
S . . . clearance between hooking portion 37 and front end of outer peripheral surface of stopper 16
10 . . . housing
11 . . . lower housing
12 . . . upper housing
13 . . . terminal accommodation chamber
14 . . . retaining portion
15 . . . cable accommodation chamber
16 . . . stopper
17 . . . locking recess
18 . . . upward rib
19 . . . long hole
20 . . . downward rib
21 . . . strain relief portion
22 . . . flexible conductive path
23 . . . terminal fitting
24 . . . terminal body portion
25 . . . terminal-side fixing portion (fixing portion)
26 . . . flat cable
27 . . . insulating sheet
28 . . . terminal fixing portion
29 . . . branch portion
30 . . . branched support portion
31 . . . through hole
32 . . . conductor
33 . . . cable-side fixing portion (fixing portion)
34 . . . reinforcing plate
35 . . . base portion (formation region of hooking portions in reinforcing plate)
36 . . . locking hole
37 . . . hooking portion
38 . . . comb teeth-like reinforcing portion
39 . . . base part
40 . . . branched reinforcing part (corresponding region to fixing portions in reinforcing plate)
41 . . . low-rigidity portion
42 . . . thin portion

What is claimed is:

1. A connector, comprising:

a flat cable formed such that a plurality of conductors are arranged in parallel on a flexible insulating sheet;

a plurality of terminal fittings held in a housing and individually fixed to front end parts of the plurality of conductors; and a reinforcing plate laminated on and integrated with a region of the insulating sheet including fixing portions of the conductors and the terminal fittings, wherein:

the reinforcing plate is provided with a hooking portion;

the housing is formed with a stopper for restricting a rearward displacement of the flat cable with respect to the housing by being brought into contact with the hooking portion, and a low-rigidity portion is formed in a region of the reinforcing plate rearward of the fixing portions and forward of the hooking portion.

2. The connector of claim 1, wherein the low-rigidity portion is constituted by a thin portion thinner than corresponding regions to the fixing portions and a formation region of the hooking portion, out of the reinforcing plate.

3. The connector of claim 2, wherein the thin portion is formed by recessing an outer surface of the reinforcing plate opposite to the insulating sheet.

4. The connector of claim 2, wherein a recessed surface of the thin portion is shaped to include a curved surface.

5. The connector of claim 1, wherein:

a front end side region of the flat cable is formed such that a plurality of branch portions cantilevered forward are arranged in parallel like comb teeth, the plurality of terminal fittings are individually fixed to front end parts of the plurality of branch portions, and the low-rigidity portion is disposed only in a region of the reinforcing plate rearward of the plurality of branch portions and continuous over an entire width of the flat cable.

* * * * *